United States Patent [19]

Dang

[11] Patent Number: 4,515,114

[45] Date of Patent: May 7, 1985

[54] TWO PART PISTON ASSEMBLY

[76] Inventor: Nguyen Dang, 2524 Clinton Ave. S., Minneapolis, Minn. 55404

[21] Appl. No.: 523,091

[22] Filed: Aug. 15, 1983

[51] Int. Cl.[3] ..... F02B 75/04

[52] U.S. Cl. ..... 123/48 B; 123/78 B

[58] Field of Search ..... 123/48 R, 48 B, 193 R, 123/193 P, 78 R, 78 B, 78 E, 78 BA

[56] References Cited

U.S. PATENT DOCUMENTS

| | | | |
|---|---|---|---|
| 669,416 | 3/1901 | Johnson | 123/78 B |
| 727,777 | 5/1903 | Foster | 123/78 B |
| 857,410 | 6/1907 | Morey | 123/78 B |
| 1,359,309 | 11/1920 | Arbeitel | 123/78 B |
| 1,377,106 | 5/1921 | Welch | 92/221 |
| 1,439,109 | 12/1922 | Kuhn | 123/78 B |
| 1,526,244 | 2/1925 | Shannon | 123/48 B |
| 1,557,987 | 10/1925 | Coryell | 92/84 |
| 1,559,595 | 11/1925 | West | 123/78 B |
| 1,743,596 | 1/1930 | Cammack et al. | 92/218 |
| 1,860,673 | 5/1932 | Jackson | 123/78 B |
| 2,127,361 | 8/1938 | Hlasney | 123/48 B |
| 2,376,214 | 5/1945 | Webster | 123/193 P |
| 2,394,269 | 2/1946 | Svete | 123/78 B |
| 2,472,928 | 6/1949 | Tien | 123/78 B |
| 2,686,512 | 8/1954 | Beam | 123/193 P |
| 3,704,695 | 12/1972 | Cronstedt | 123/78 B |
| 3,915,141 | 10/1975 | Ottl et al. | 123/193 P |
| 3,923,032 | 12/1975 | Studenroth | 123/193 P |
| 4,084,553 | 4/1978 | Forde et al. | 123/48 B |
| 4,114,519 | 9/1978 | Speaight | 92/221 |

*Primary Examiner*—Craig R. Feinberg

*Attorney, Agent, or Firm*—Merchant, Gould, Smith, Edell, Welter, & Schmidt

[57] ABSTRACT

A two-part piston assembly is disclosed for increasing the removal of exhaust gases from an internal combustion engine during the exhaust stroke. The two-part piston (14*a*), (16*a*), shown in several embodiments, may include an appropriately adjusted spring assembly (54), (56), (50), (52) to insure that the assembly will be in a compressed state during compression and a distended state during exhaust. This can also be accomplished by a cam mechanism (78) having a ratchet (110) with pawls (114), which operate on the angular movement of the crankshaft (18) with the cam operating a cam follower (80) producing the same result as in the previous embodiments.

5 Claims, 14 Drawing Figures

TWO PART PISTON ASSEMBLY

TECHNICAL FIELD

The present invention relates to pistons and more particularly, pistons when the crown is a separate part attached to the piston body.

BACKGROUND OF THE INVENTION

In a four-stroke engine, the piston reaches its apex during the compression and exhaust strokes. The distance from the cylinder head to the piston crown during compression determines the compression ratio and is critical to the operation of the invention. This minimum compression space occurs also in the exhaust stroke of the invention and creates an undesirable effect. It would be advantageous to completely clear the cylinder of all exhaust gases. However, only a portion of the gases can be driven off as the piston crown never reaches the valve head assembly.

The present invention solves this problem by permitting the piston to expand during the exhaust stroke and compress during the compression stroke. The result is that, while compression is unaffected, a substantially greater portion of the exhaust gases is driven out of the cylinder during the exhaust stroke.

SUMMARY OF THE INVENTION

The present invention relates to a two-part piston assembly for use in the cylinder bore of a four-stroke internal combustion engine. Having a piston with upper and lower parts coming out one on top of the other means for connecting the parts on a slideable engagement whereby the parts may move relative to each other between distended and compressed positions along an axis defined by the central axis defined by the cylinder bore and means for causing the parts to be distended during the exhaust stroke of the engine and compressed during the compression stroke.

According to further aspects of the invention, camming means are provided for balancing the parts into the respective distended and compressed positions and balancing means for producing sufficient force to overcome friction with the cylinder wall while being insufficient to overcome the force of gas compression during the compression stroke so that the parts are distended during the exhaust stroke but compressed during the compression stroke.

Various advantages and features which characterize the invention are pointed at with particularity in the claims annexed hereto and forming a part hereof. However, for a better understanding of the invention, its advantages and objects attained by its use, a reference should be had to the drawings which form a further part hereof, and to the accompanying description matter in which there are illustrated and described preferred embodiments of the invention.

DETAILED DESCRIPTION OF THE DRAWINGS

FIG. 1 is taken during the expansion or intake stroke, FIG. 2 is taken during compression, FIG. 4 is taken during exhaust and FIG. 3 is taken at peak compression or ignition.

DETAILED DESCRIPTION OF THE INVENTION

Figure 1:
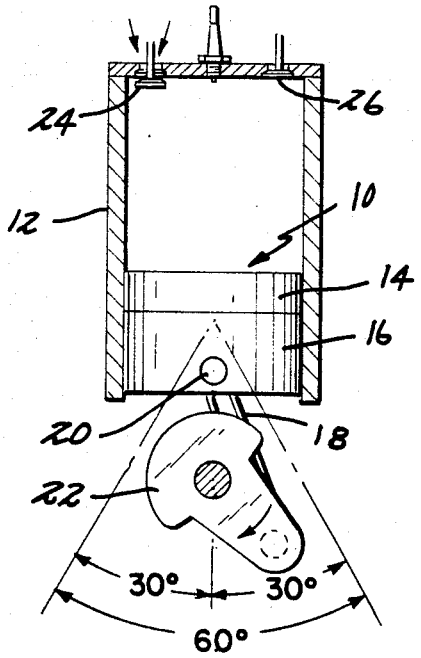
FIGS. 1–4 show in cross-sectional view of a four-stroke combustion engine employing a piston in accordance with an embodiment of the present invention.

Referring to the drawings in detail, FIGS. 1–4 show a schematic cross-sectional view of a piston 10 and cylinder wall 12 through the various strokes of a four-cycle engine. Piston 10 is schematically shown comprised of a top or crown portion 14 sitting atop the lower portion 16. The two portions 14 and 16 are slideably connected, as will be explained in detail hereinafter. The lower portion 16 is attached to the connecting rod 18 by means of a wrist pin 20 at one end and to crankshaft 22 at the other end.

FIG. 1 shows the crank shaft with a clockwise rotation on its way to approaching bottom dead center position during the intake stroke. Intake valve 24 is shown open, while exhaust valve 26 is closed.

Figure 2:
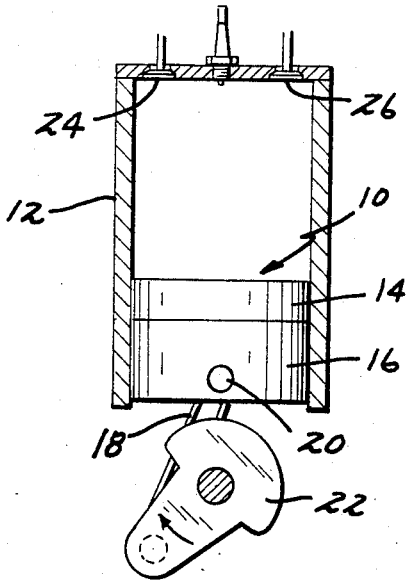

FIG. 2 illustrates the beginning of the compression stroke. Notice that crown 14 and lower portion 16 of the piston are in contact. As was also the case in FIG. 1.

Figure 3:
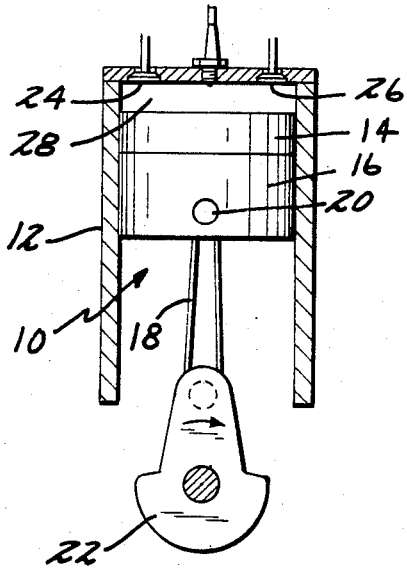

FIG. 3 illustrates top dead center just prior to ignition. Top portion 14 and 16 are biased against each other by the compressive force of the gas contained within space 28.

Figure 4:
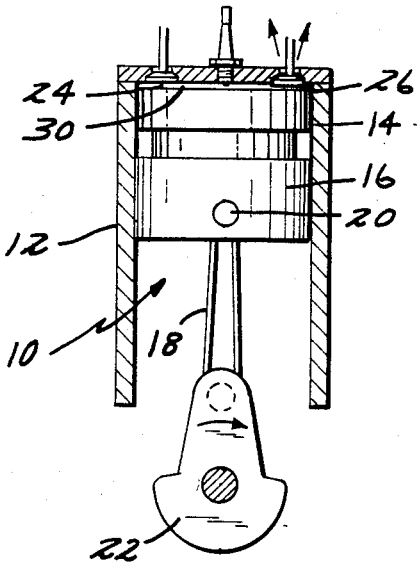

FIG. 4 illustrates the exhaust stroke with the exhaust valve 26 open and intake valve 24 closed. Notice that crown 14 and lower position 16 of the piston are now in a distended position and that space 30, corresponding to space 28 in FIG. 3 is substantially smaller than the corresponding space during compression, indicating that much more exhaust can be driven out of the cylinder by the system. In the preferred embodiment, a space would be made as small as possible such that it would not contact either of the valves. It is preferred that the crown be made flat. However, it is possible to use a sculptured crown so long as clearance is provided for the valve.

Figure 5:
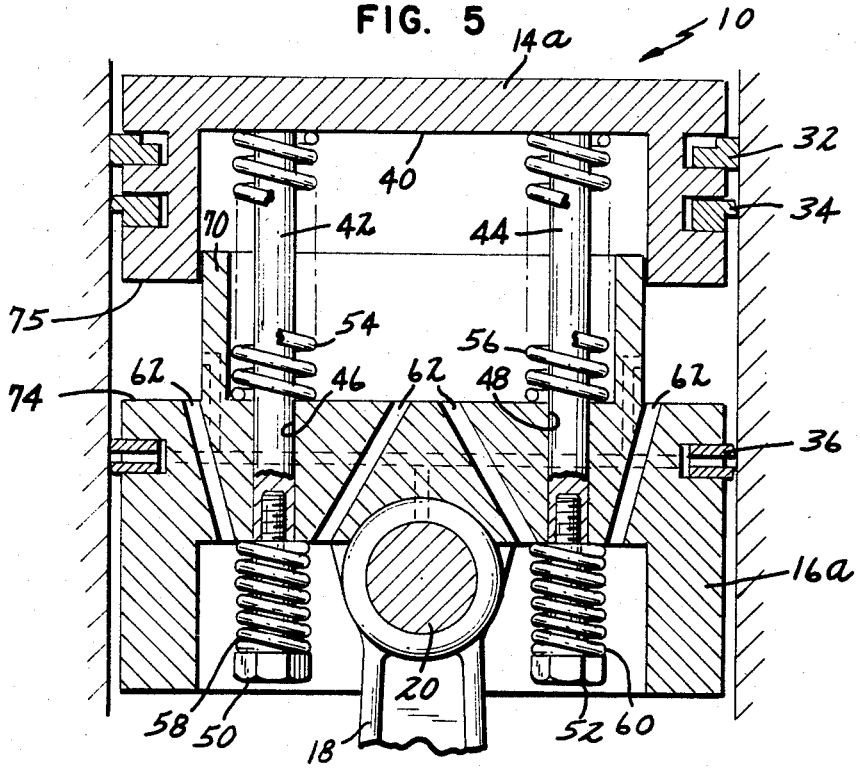
FIG. 5 shows a cross-sectional view of a piston in accordance with the present invention.

Turning to a detailed view of various embodiments of the two-part piston, FIG. 5 shows one embodiment thereof. The top or crown portion of **14*a* may include a pair of piston rings 32 and 34 as is known in the art. The lower portion 16*a* may likewise include a ring 36. Extending from the bottom side 40 of crown 14A are a pair of guide pins 42 and 44. Pins 42 and 44 pass through like sized apertures 46 and 48 in bottom portion 16*a*. The ends of the guide pins are fitted with nut-like fasteners 50 and 52 by means of threads, or alternatively, the ends may be deformed so that their diameters are greater than that of holes 46 and 48**.

Bias springs 54 and 56 are preferably located around and coaxially aligned with pins 42 and 44 in the space between crown 14*a* and bottom 16*a* of the piston. A set of shock absorbing springs 58 and 60 are located likewise around guide pins 42 and 44 and concentric therewith in the portion between 16*a* and fasteners 50 and 52.

Oil passages 62 are provided through bottom portion 16*a* so that oil may reach the space between top and bottom portions 14*a* and 16*a* and the guide pins.

The connecting rod 18 is connected to the piston in the normal fashion known in the art.

The choice of bias springs 54 and 56 is critical in this embodiment. They must have sufficient biasing force to maintain the piston in its extended position (i.e. fasteners 50 and 52 in abutment with springs 58 and 60, fully compressed) during the exhaust stroke in spite of friction resulting between the piston rings and the cylinder wall. Thus, the bias springs 54 and 56 must have sufficient strength to overcome these frictional forces. Simultaneously, these springs must be "weak" enough that the crown 14*a* will contact the bottom portion 16*a* on contact annular rings 74 and 75 during the compression stroke at the last moment before ignition. Thus, there is an upper and lower limitation on the spring force employed. The proper force can be determined by actual experimentation and/or testing. It is important that the latter condition (contact with annular rings 74 and 75) in the compressed state be attained to prevent piston damage which might result in ignition when the two parts come together under high pressure.

Springs 58 and 60 can be of substantially less spring force, such that they will not interfere with the operation of springs 54 and 56 but will perform the function of absorbing the force of the top and bottom piston portions when they go from the compressed to the distended positions.

PREFERRED EMBODIMENT

Because of the possible noise and wear on the piston parts when coming together in the previous embodiment, it may be preferable to employ the embodiment shown in FIG. 6–13 which circumvent the problem of such spring selection by employing other mechanical means. The theory of operation is, however, unchanged.

To the extent that parts of the piston and cylinder are the same as in the previous embodiment, like numerals are employed. In this embodiment, the compression and distension of the two parts 14*a* and 16*a* of the piston is controlled by the action of a cam 78 and a cam follower 80 which extends downwardly from the bottom side 40 of crown 14*a*.

Springs 84 and 86 are attached to the top and bottom portions of the pistons by means of lugs 88 and provide spring force sufficient to maintain the cam follower 80 in contact with the cam 78, except for the short period when the cam follower is in line with the points of minimum diameter 90 of the cam. At such points, it is preferable to have the shoulder 74 of part 16*a* to contact like shoulder 75 of part 14*a* so that during compression, the piston crown 14*a* is adequately supported on the bottom portion 16*a* rather than merely by the cam follower 80.

As an alternative to springs 84 and 86, springs 92 and 94 may be employed in the position occupied by springs 58 and 60 in the previous embodiment. Springs 92 and 94 are an alternative to 84 and 86, but may also be employed as additional springs to provide for a longer life of the piston and this spring action. If the springs are not employed, guide pins 42 and 44 may be eliminated, but only if other mechanical means are provided to prevent the portions of the pistons from counter-rotating.

Figure 6:
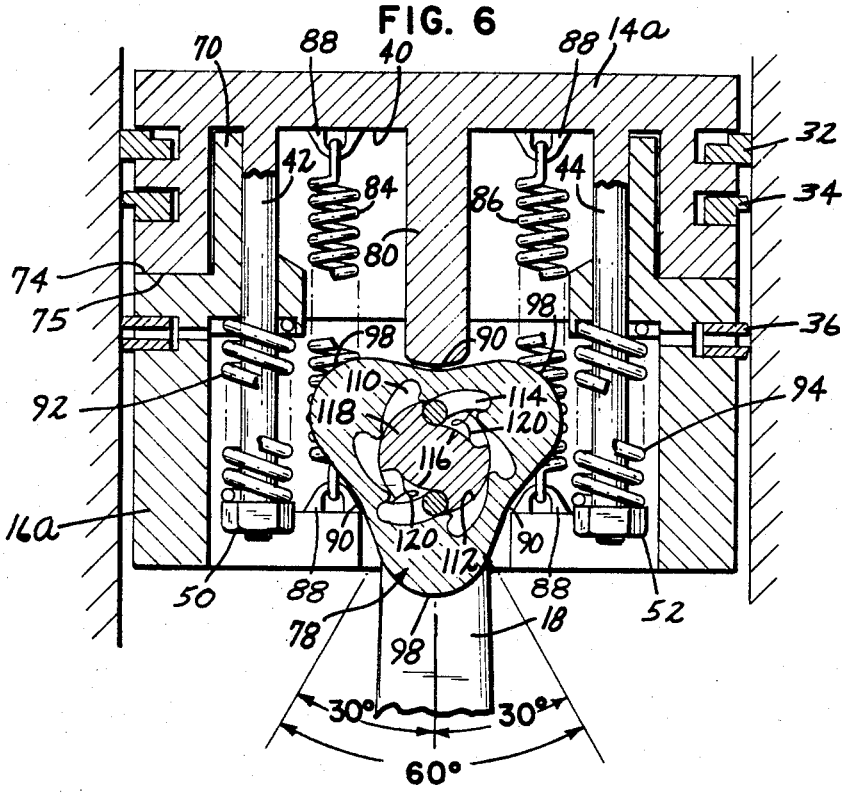
FIG. 6 shows in cross-sectional view a piston in accordance with the present invention, in the preferred embodiment.
Figure 7:
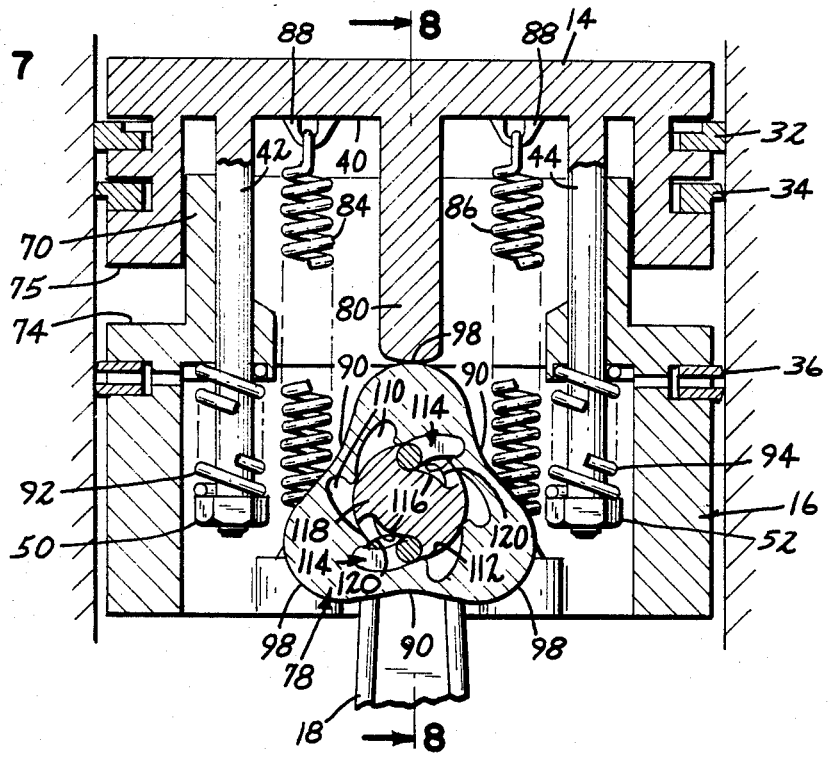
FIG. 7 is a Figure like FIG. 6 showing a different position of the parts thereof.
Figure 8:
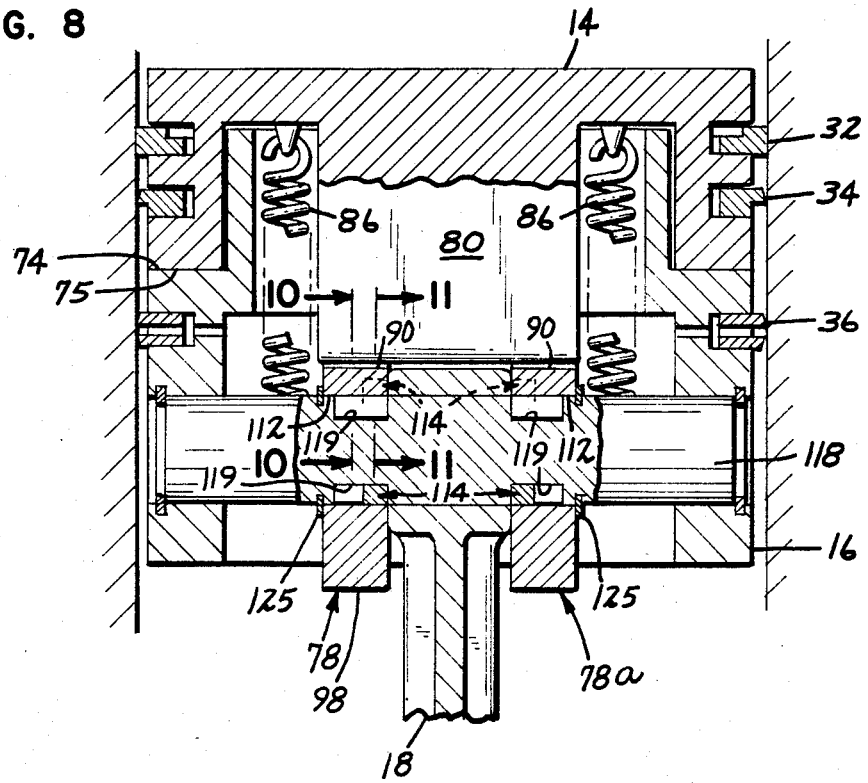
FIG. 8 is a Figure taken along lines 8—8 of FIG. 7.

FIG. 7 of the drawing is similar to that of FIG. 6, except that it shows the contact between the cam follower 80 and cam 78 at its point of apex 98.

Details of the cam structure are shown most clearly in FIGS. 8–11. In this preferred embodiment, duel cams 78 and 78*a* are shown on opposing sides of the connecting rod 18.

Figures 9, 10, 11:
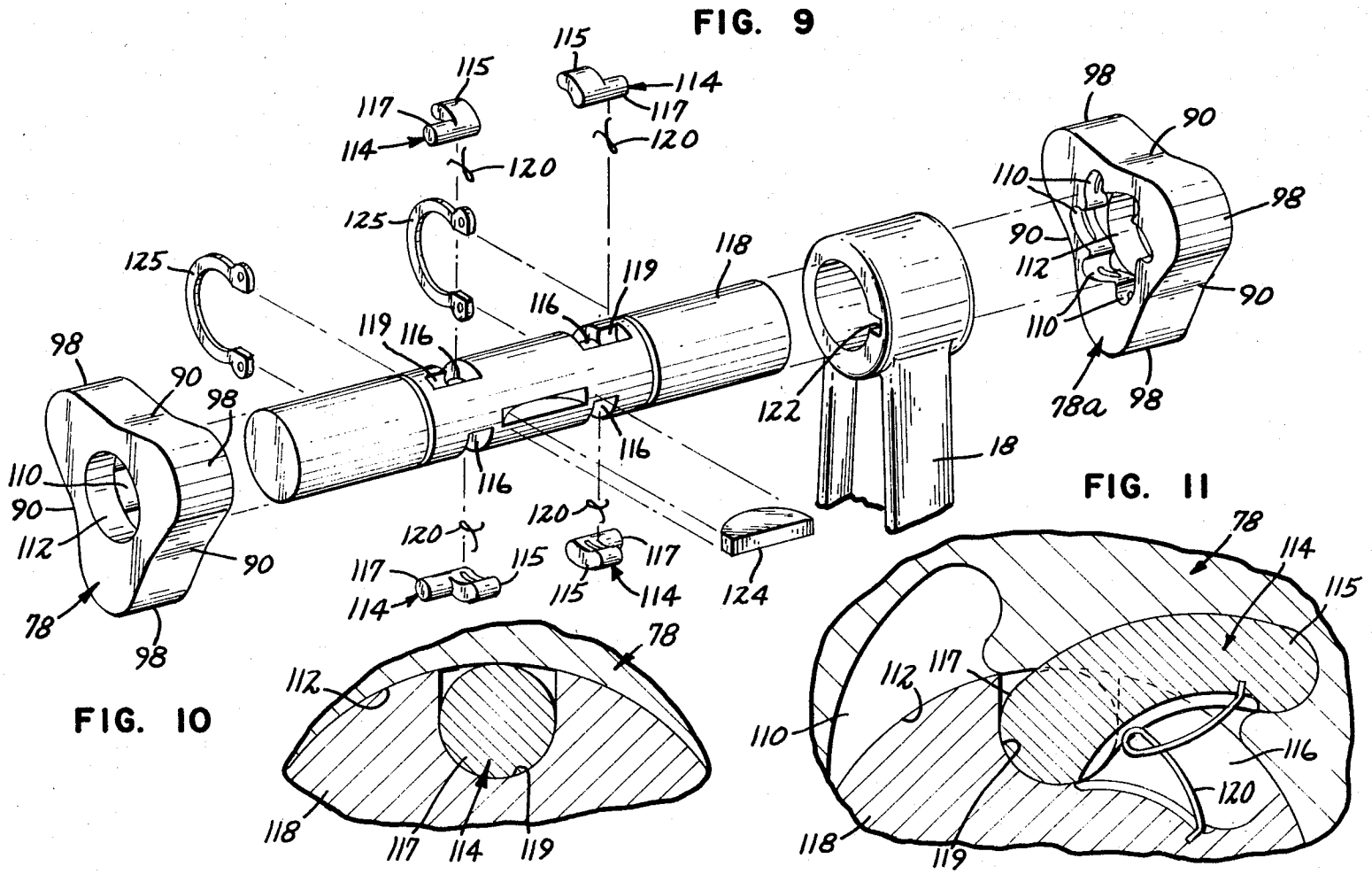
FIG. 9 is an exploded perspective view of the camming mechanism shown in FIGS. 6–8.
FIG. 10 is a detailed sectional view of a portion of the camming mechanism of FIG. 9 as seen from the lines 10—10 of FIG. 8.
FIG. 11 is a detailed sectional view of a portion of the camming mechanism, with pawls of FIG. 9 as seen from the lines 11—11 of FIG. 8.

In FIG. 9, the cam assembly is shown in exploded view. Cams 78 and 78*a* are mirror images of each other and have a plurality of ratchet teeth 110 around an aperture 112 therein. Teeth 110 are sized to receive pawls 114, which reside in like-sized recesses 116 in wrist pin 118. Each cam has two pawls 114, and they are preferably oriented along the verticle axis so that the force of gravity will operate in the event that by springs 120 fail. These springs tend to bias the pawls outwardly from the wrist pins. Wrist pin 118 is fixed to the connecting rod 18 by means of a key way 122 in the crankshaft and a like key 124. This insures that the wrist pin will undergo angular rotation along with the crankshaft and, therefore, ratcheting the pawls.

Figure 12:
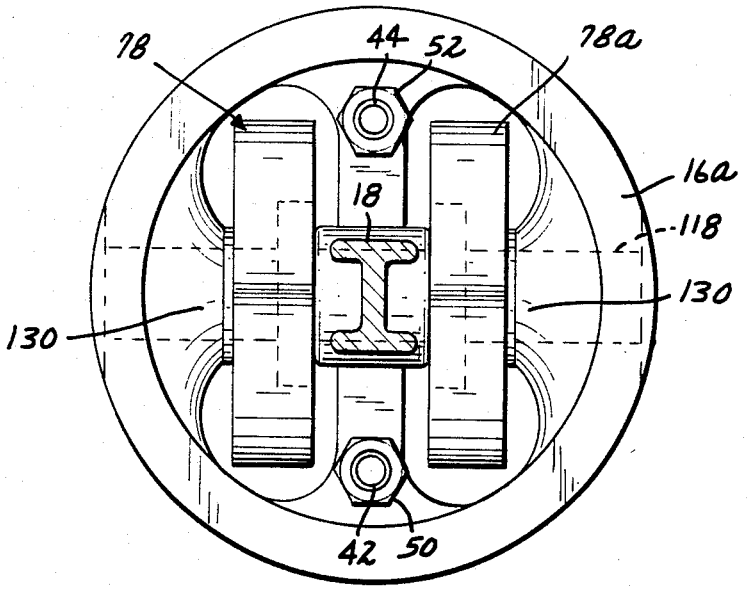
FIG. 12 is a sectional view showing an alternate piston construction in and showing the camming mechanism of FIG. 9 in place.

Semicircular clips 125 maintain the cams onto the wrist pins by engaging a lip on the outer surface of the cam in the manner known widely in the automotive art. As an alternative, the cams may be held in place (i.e. prevented from lateral movement) by sculpturing the underside of the piston as shown in FIG. 12 such that the piston body includes portions 130 which are relatively adjacent to cams 78 and 782, thereby maintaining them in their relative positions without the need for clips 125.

Pawls 114 include a curved portion 115 and a cylindrical pivot portion 117, which is received within a portion 119 of recesses 116 within the wrist pin 118. Aperature 112 captures portion 117 in portion 119 to permit pivoting of pawls 114 into and out of teeth 110 and respective recess 116.

Figure 13:
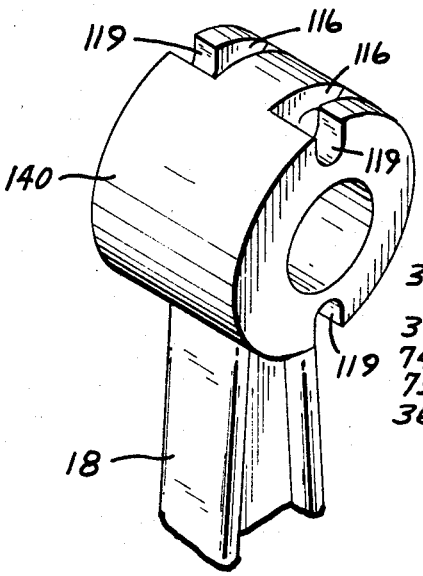
FIG. 13 is an alternate embodiment of a portion of the camming mechanism corresponding to that in FIG. 9.

FIG. 13 shows an alternative structure for holding pawls 114. In the embodiment of FIG. 9, recesses or notches 116 are formed into the wrist pin 118, and the wrist pin must be then secured to the connecting rod 18. In FIG. 13, recesses 116 and portions 119 are formed as part of or attached directly to portion 140 of connecting rod 18. The advantage of this construction is that the wrist pin 118 need not be specially formed and can rotate freely within the connecting rod 18 since the key way is not required. The cam 78 will be structurely identical, however, it will be slightly enlarged to accommodate the larger diameter of portion 140.

Figure 14:
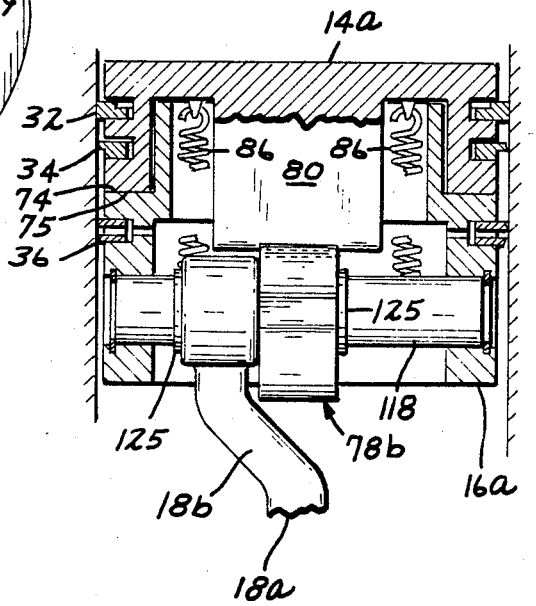
FIG. 14 is a view similar to FIG. 8, but showing a still farther embodiment of the present invention.

Another alternative to the structure shown in FIGS. 9–13 is that shown in FIG. 14 which illustrates the use of a single cam 78*b* centered within the piston. The connecting rod 18*a* includes an offset portion 18*b* to accommodate for this central location of the cam 78*b*. The advantage of this structure is that only a single cam is required.

In the preferred embodiment, the crankshaft is configured to undergo an angular displacement of 30 degrees off center in both directions. As such, three apexes 98 and depressions 90 are required, along with six ratchet teeth 110 for the two pawls 114. If a different angular rotation is employed, a like adjustment must be made in the cam and ratchet to insure that the crown and bottom portion of the piston will be in a distended position as caused by the cam action during the exhaust stroke and be in the compressed position during the compression stroke.

With the present invention employed on internal combustion engines, improved volumetric efficiency is obtained since more of the exhaust air will be expelled during the exhaust stroke and, therefore, the intake air will be cleaner and more volatile. Likewise, it is expected that a reduction in emissions will thus result, since the fuel air mixture will be cooler and contain fewer combustion by-products.

Numerous characteristics and advantages of the invention have been set forth in the foregoing description, together with details of the structure and function of the invention, and the novel features thereof are pointed out in the appended claims. The disclosure, however, is illustrated only, and changes may be made in detail especially in matters of shape, size and arrangement of parts, within the principle of the invention to the full extent indicated by the broad general meaning of the terms in which the appended claims are expressed.

I claim:

1. A two-part piston assembly for use in the cylinder bore of a four-stroke internal combustion engine having a connecting rod and a wrist pin comprising a piston having upper and lower parts, one atop the other, means for slideably connecting said parts whereby they move relative to each other between distended and compressed positions along an axis defined by the central axis of the cylinder bore, a contact member extending from said upper part toward said lower part, camming means responsive to the periodic angular movement of the connecting arm to rotate said camming means to engage said contact member and distend the parts when the piston is in the exhaust stroke and compress the parts when the piston is in the compression stroke, said camming means including a ring member operatively connected to said wrist pin, said ring member including at least one pawl in swiveling engagement therewith, and a cam having a plurality of lobes on its outer periphery and a ratchet wheel on its inner periphery sized to receive said at least one pawl, said lobes being aligned to engage said contact member.

2. An assembly according to claim 1, wherein said cam includes three lobes, wherein said ratchet wheel includes six indentations spaced around the inner periphery at locations such that the angular movement of the connecting rod positions the apex of one of said lobes against said contact member at the exhaust stroke.

3. An assembly according to claim 1 wherein said ring member and cam are centrally located along the length of said wrist pin and wherein said connecting rod is operatively connected to said ring member and adjacent thereto, said connecting rod including an offset portion to align said piston with the crankshaft.

4. An assembly according to claim 1 wherein said camming means is located adjacent to and on both sides of the connecting rod.

5. An assembly according to claim 4 including at least one spring connected to said upper and lower parts to maintain said contact member and said cam in constant contact.

* * * * *